US011081835B2

(12) United States Patent
Kamemura

(10) Patent No.: US 11,081,835 B2
(45) Date of Patent: Aug. 3, 2021

(54) CONNECTOR

(71) Applicant: Sumitomo Wiring Systems, Ltd., Mie (JP)

(72) Inventor: Masato Kamemura, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/772,142

(22) PCT Filed: Dec. 3, 2018

(86) PCT No.: PCT/JP2018/044356
§ 371 (c)(1),
(2) Date: Jun. 11, 2020

(87) PCT Pub. No.: WO2019/124030
PCT Pub. Date: Jun. 27, 2019

(65) Prior Publication Data

US 2021/0083422 A1 Mar. 18, 2021

(30) Foreign Application Priority Data

Dec. 19, 2017 (JP) ..... JP2017-242562

(51) Int. Cl.
*H01R 13/58* (2006.01)
*H01R 13/52* (2006.01)

(52) U.S. Cl.
CPC ..... *H01R 13/5812* (2013.01); *H01R 13/5208* (2013.01)

(58) Field of Classification Search
None
See application file for complete search history.

(56) References Cited

U.S. PATENT DOCUMENTS 4,640,568 A * 2/1987 Magourou ..... H01R 13/59 439/460
5,131,864 A * 7/1992 Van Zeelst ..... H01R 13/53 174/652

(Continued)

FOREIGN PATENT DOCUMENTS

DE 102012206102 B4 * 6/2020 ..... H01R 13/5208
JP 9-92385 4/1997

(Continued)

OTHER PUBLICATIONS

International Search Report dated Feb. 12, 2019.

*Primary Examiner* — Ross N Gushi
(74) *Attorney, Agent, or Firm* — Gerald E. Hespos; Michael J. Porco; Matthew T. Hespos

(57) ABSTRACT

A connector (10) has a wire, a rubber plug (60) fit on an outer surface of the wire and a housing 20 including a forwardly-open plug accommodating portion (22). The rubber plug (60) is sandwiched between an inner peripheral surface of the plug accommodating portion (22) and the outer surface of the wire. A retainer holds the rubber plug 60 in the plug accommodating portion (22) by being mounted on the plug accommodating portion (22) from the front. The retainer includes deflecting pieces (35) relatively displaceable with respect to the outer surface of the wire and fixing pieces (36) relatively undisplaceable with respect to the wire. The housing (20) includes push-in pieces (25) for pushing the deflecting pieces (35) into the outer surface of the wire. The wire is held in the retainer by the deflecting pieces (35) pushed into the surface of the wire and the fixing pieces (36).

8 Claims, 15 Drawing Sheets

(56) References Cited

U.S. PATENT DOCUMENTS

| | | | | |
|---|---|---|---|---|
| 5,890,927 | A | 4/1999 | Yashima | |
| 6,948,970 | B2 * | 9/2005 | Hayashi | H01R 13/5812 439/457 |
| 9,715,068 | B2 * | 7/2017 | Cairns | H02G 15/04 |
| 10,601,172 | B2 * | 3/2020 | Misu | H01R 13/582 |
| 10,770,829 | B2 * | 9/2020 | Kurita | H01R 13/24 |
| 2008/0003876 | A1 | 1/2008 | Fukaya et al. | |
| 2010/0151721 | A1 | 6/2010 | Tyler | |
| 2018/0191099 | A1 | 7/2018 | Hamada et al. | |

FOREIGN PATENT DOCUMENTS

| | | |
|---|---|---|
| JP | 3288217 | 3/2002 |
| JP | 4752644 | 6/2011 |
| JP | 2012-511804 | 5/2012 |
| JP | 6224041 | 10/2017 |

* cited by examiner

CONNECTOR

BACKGROUND

Field of the Invention

This specification relates to a connector.

Related Art

Japanese Unexamined Patent Application Publication No. 2012-511804 discloses a shield connector with a strain relief mechanism. This connector assembly includes an inner housing assembly, an outer housing assembly, a spacer, a cable seal, a collet and a retainer. The cable seal seals against the intrusion of moisture and other foreign matter into the outer housing assembly through the rear end of the outer housing assembly. The collet fixes the cable to ensure that a tension from the cable does not act on the connection of the cable seal and a shield. The collet includes a finger-like portion to be pushed into the cable. If the retainer is assembled with the outer housing assembly from behind the collet, a push-in portion of the retainer pushes the finger-like portion of the collet so that the cable can be fixed to the collet.

However, the cable of the above-described connector assembly is fixed by three components, i.e. the outer housing assembly, the collet and the retainer, to prevent tension on the cable from acting on the connection of the cable seal and the shield. The, cost increases with the number of components.

SUMMARY

A connector disclosed by this specification is provided with a wire, a rubber plug fit on an outer peripheral surface of the wire and a housing including a forwardly open rubber plug accommodating portion. The rubber plug is sandwiched between an inner peripheral surface of the rubber plug accommodating portion and the outer peripheral surface of the wire. The connector also includes a retainer for holding the rubber plug in the rubber plug accommodating portion by being mounted on the rubber plug accommodating portion from the front. The retainer includes a deflecting piece that is relatively displaceable with respect to the outer peripheral surface of the wire and a fixing piece that is relatively undisplaceable with respect to the outer peripheral surface of the wire. The housing includes a push-in piece for pushing the deflecting piece into the outer peripheral surface of the wire, and the wire is held in the retainer by the deflecting piece pushed into the outer peripheral surface of the wire by the push-in piece and the fixing piece.

According to this configuration, the push-in piece of the housing pushes the deflecting piece of the retainer into the outer peripheral surface of the wire when mounting the retainer on the rubber plug accommodating portion of the housing. The deflecting piece of the retainer exerts forces to expand the diameter of the wire in a direction different from a push-in direction. However, the fixing piece suppresses the expansion in diameter of the wire. Thus, the wire is pressed by both the deflecting piece and the fixing piece and is held in the retainer. Therefore, the wire can be held by two components, i.e. the housing and the retainer, and the number of components can be reduced as compared to the case where the wire is held by three components as before.

Further, if an attempt is made to assemble the retainer with the housing while the deflecting piece is pushed into the outer peripheral surface of the wire, the wire may be damaged, such as by the biting of the deflecting piece and the fixing piece into a coating of the wire. However, according to the above configuration, the deflecting piece gradually pushes the outer peripheral surface of the wire as the retainer is assembled with the housing. Thus, a force for pushing the outer peripheral surface of the wire gradually increases and the wire is less likely to be damaged.

Plural deflecting pieces and plural the fixing pieces may be arranged alternately in a circumferential direction along the outer peripheral surface of the wire, and slits may be formed between the deflecting pieces and the fixing pieces. According to this configuration, the deflecting pieces and the fixing pieces are adjacent via the slits. Thus, even if parts of the outer peripheral surface of the wire on both sides of the deflecting pieces are going to be expanded in diameter when the outer peripheral surface of the wire is pushed by the deflecting pieces, the fixing pieces suppres the diametric expansion of these parts.

The push-in piece may project forward from an opening edge of the rubber plug accommodating portion, and the retainer may include a front wall formed with a push-in piece insertion hole through which the push-in piece is inserted. According to this configuration, the insertion of the push-in piece through the push-in piece insertion hole enables the front wall of the retainer to be brought closer to the rubber plug accommodating portion, and the entire connector can be reduced in size.

The fixing piece may project forward from the front wall, and the fixing piece and the front wall may be coupled by a deflection preventing rib. According to this configuration, the fixing piece is coupled to the front wall and the deflection preventing rib at two positions Thus, the deflection of the fixing piece can be prevented reliably.

The deflecting piece may project forward from the front wall, and a lance may project in a displacing direction of the deflecting piece on a front end of the deflecting piece. The push-in piece may push the lance and cause the deflecting piece to deflect into the outer peripheral surface of the wire. According to this configuration, the lance is located on the front end of the deflecting piece. Thus, the pushing of the outer peripheral surface of the wire is started at a later timing and the wire is even less likely to be damaged.

According to the connector disclosed by this specification, it is possible to reduce the number of components while preventing the damage of a wire.

DETAILED DESCRIPTION

Figure 1:
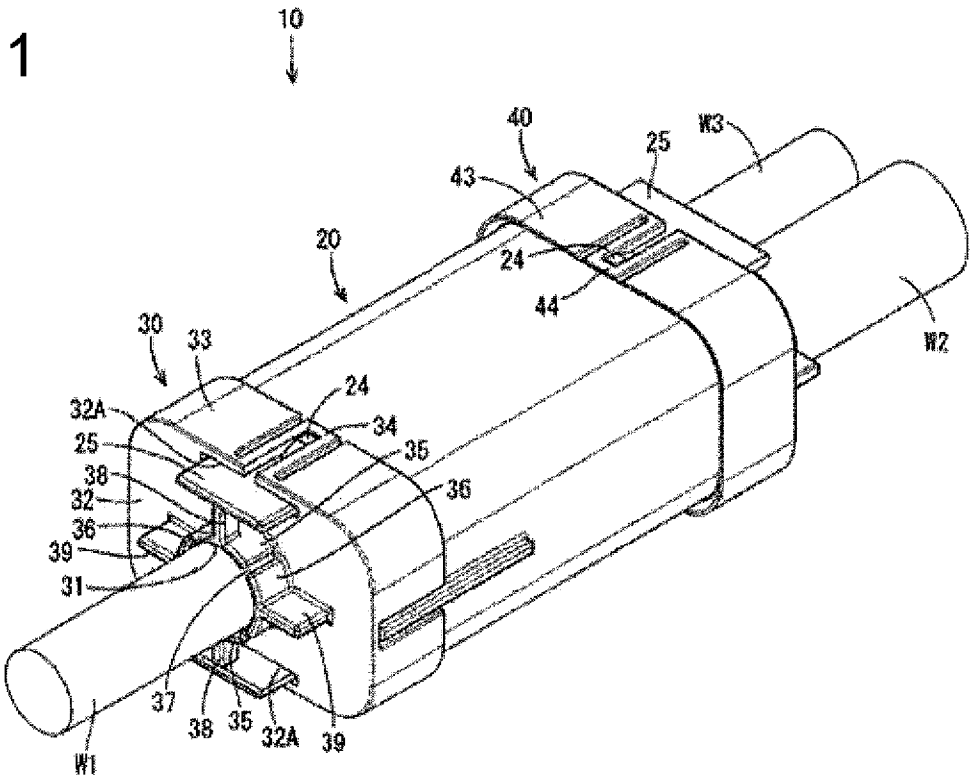
FIG. 1 is a perspective view of a connector.
Figure 2:
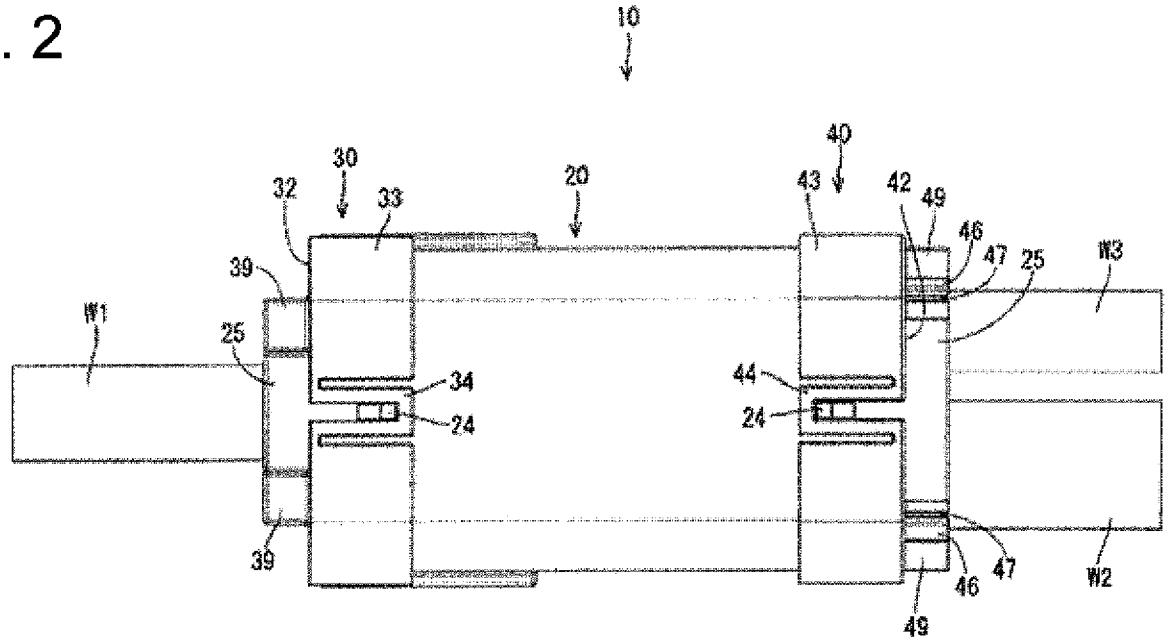
FIG. 2 is a plan view of the connector.
Figure 3:
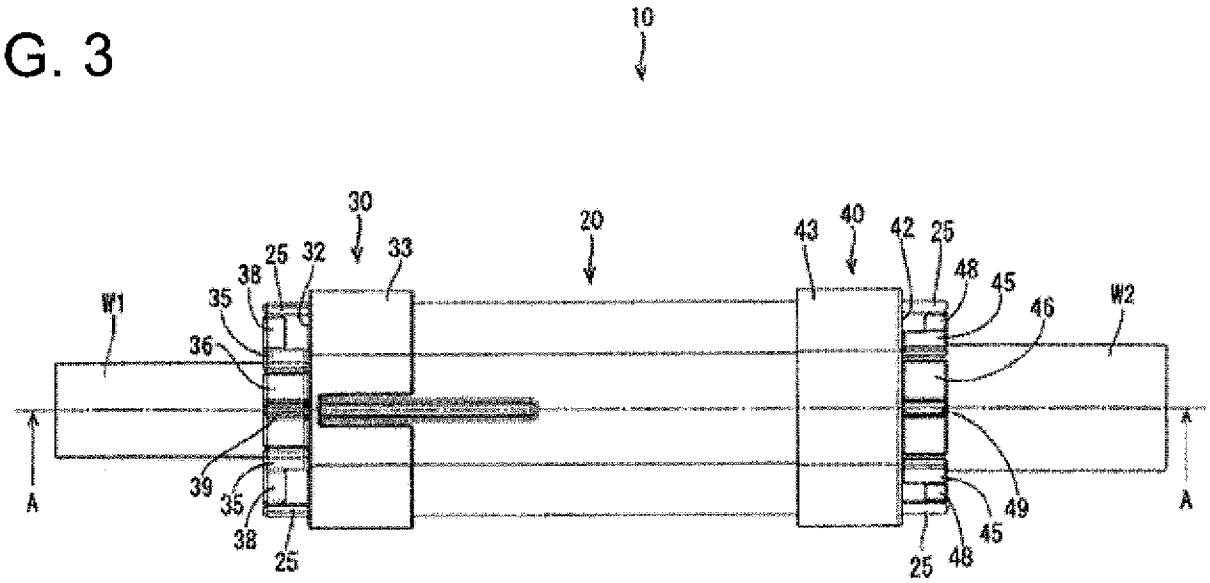
FIG. 3 is a side view of the connector.

An embodiment is described with reference to FIGS. 1 to 16. A connector 10 of this embodiment includes a housing 20 extending in a front-rear direction, front and rear retainers 30, 40 mounted on both front and rear parts of the housing 20, a first wire W1 pulled out forwardly from the first retainer 30 on a front side and a second wire W2 and a third wire W3 pulled out rearwardly from the second retainer 40 on a rear side, as shown in FIG. 1. As shown in FIG. 2, the first wire W1 is smaller in diameter than the second wire W2 and larger in diameter than the third wire W3. A current input from the second wire W2 is branched and output to the first and third wires W1, W3.

Figure 4:
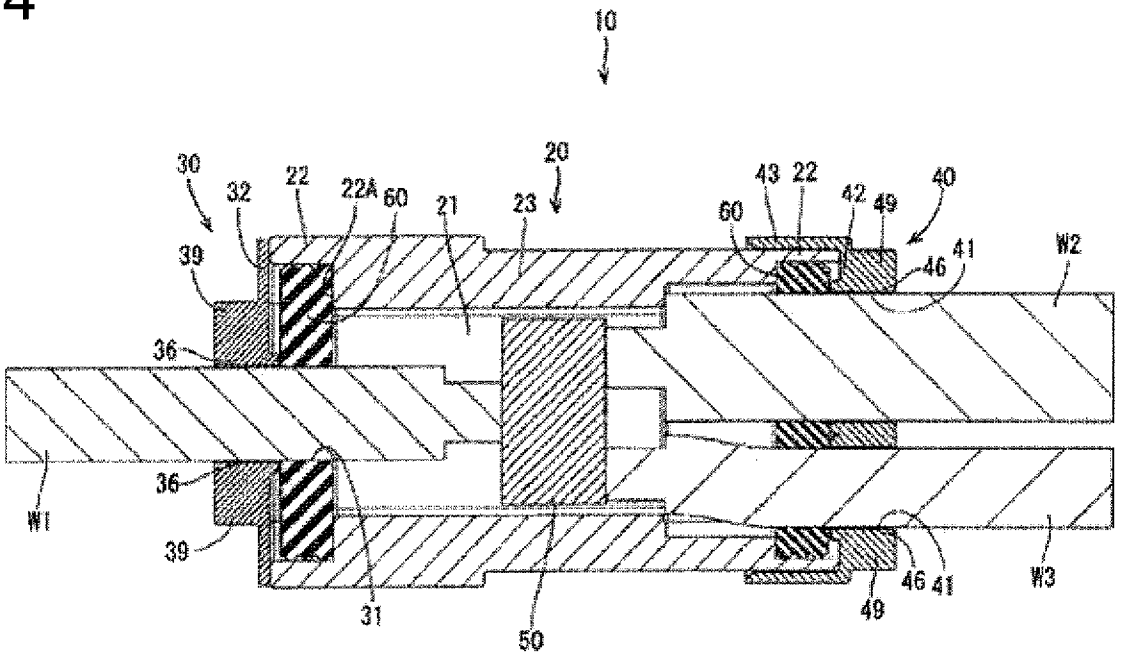
FIG. 4 is a section along A-A in FIG. 3.
Figure 5:
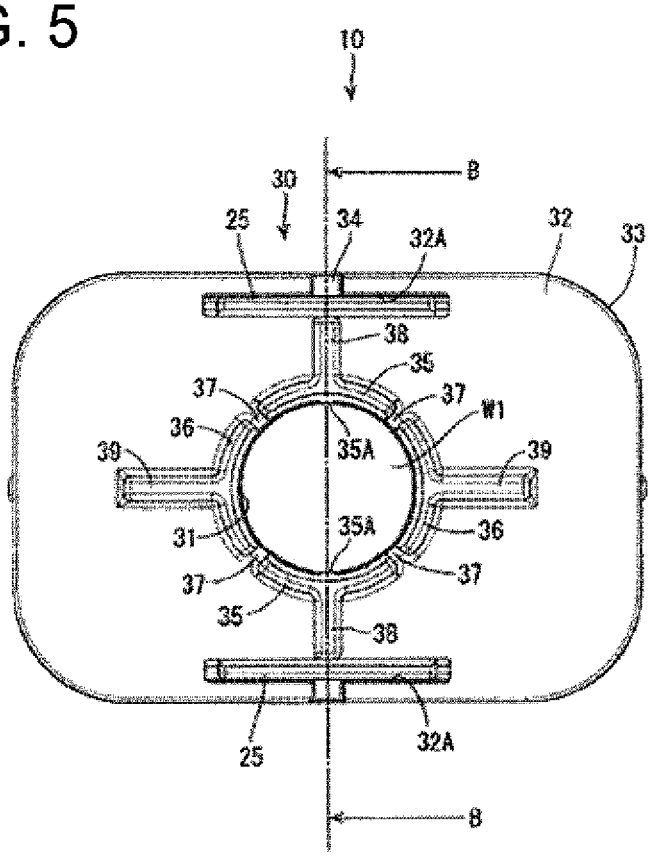
FIG. 5 is a front view of the connector.

As shown in FIG. 4, a cavity 21 penetrates the housing 20 in the front-rear direction. A conductive member 50 for conductively connecting cores of the wires W1, W2 and W3 is accommodated in the cavity 21. The cores of the wires W1, W2 and W3 are connected to the conductive member 50, for example, by resistance welding. In this way, the first, second and third wires W1, W2 and W3 are connected conductively to each other.

Front and rear rubber plug accommodating portions 22 are provided in both front and rear parts of the housing 20, and rubber plugs 60 are accommodated inside the front and rear rubber plug accommodating portions 22. The front rubber plug accommodating portion 22 is open forward, and the rear rubber plug accommodating portion 22 is open rearward. Internal spaces of the respective rubber plug accommodating portions 22 constitute parts of the cavity 21 and communicate with each other via a conductive member accommodating portion 23 that accommodates the conductive member 50 inside.

Figure 9:
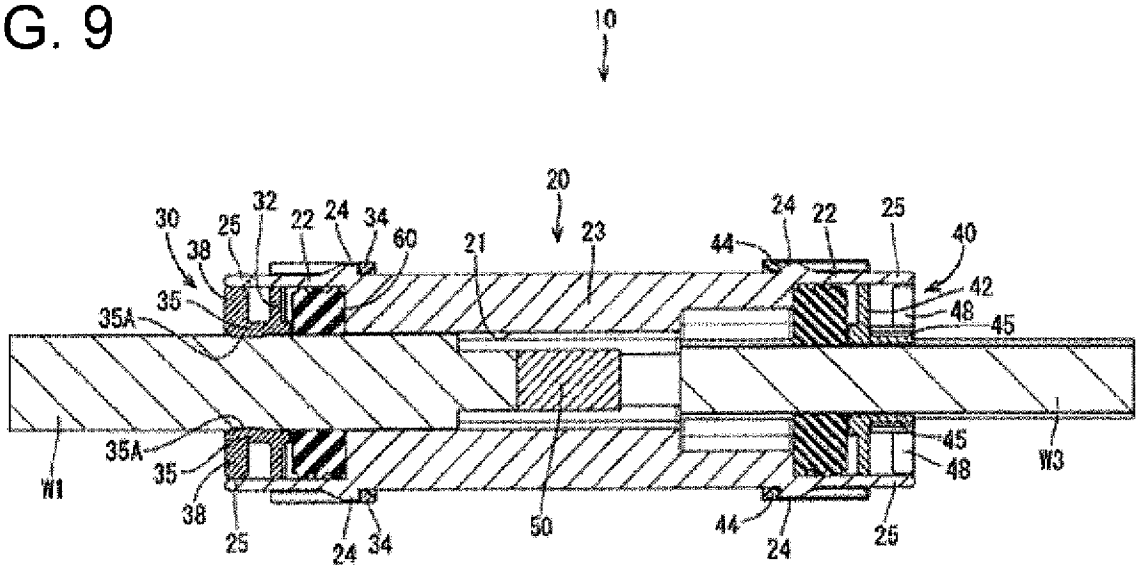
FIG. 9 is a section along B-B in FIG. 5.
Figure 10:
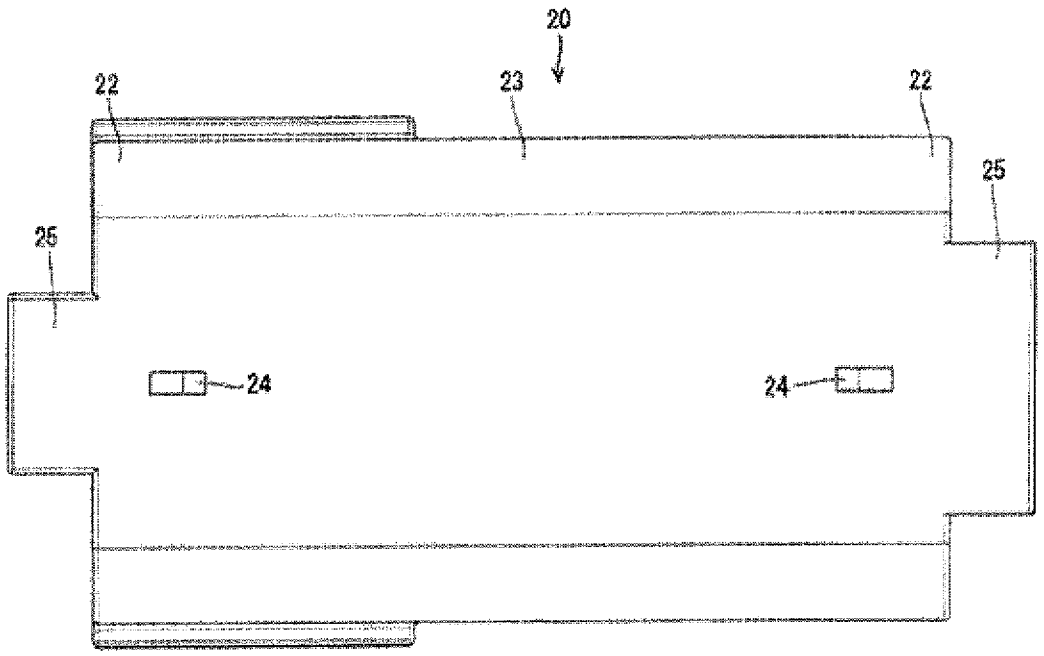
FIG. 10 is a plan view of the housing.
Figure 11:
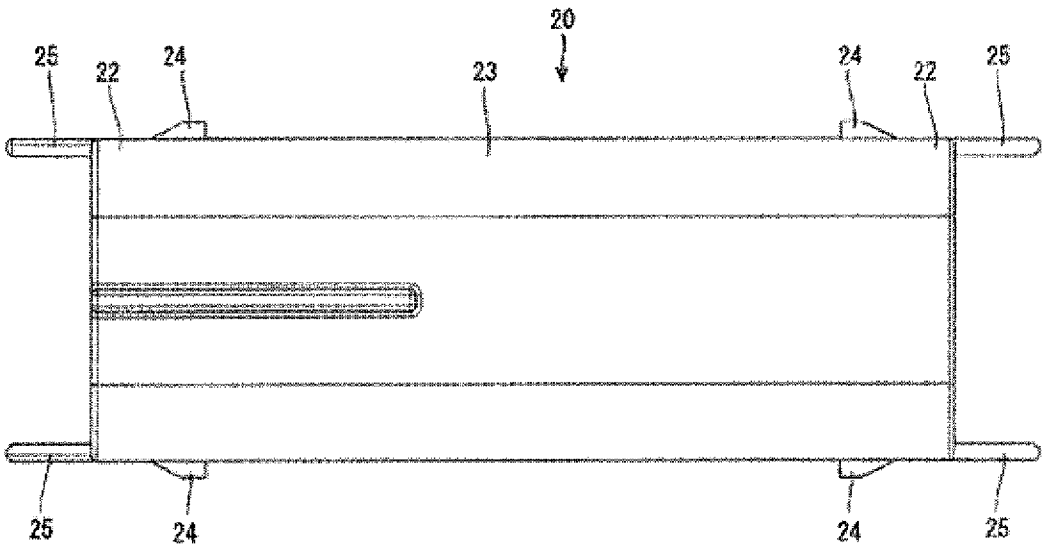
FIG. 11 is a side view of the housing.

As shown in FIGS. 10 and 11, upper and lower lock protrusions 24 are provided on both upper and lower surfaces in the front part of the housing 20, and upper and lower lock protrusions 24 are provided on both upper and lower surfaces in the rear part of the housing 20. As shown in FIG. 9, the lock protrusions 24 are disposed at positions aligned with back walls 22A of the rubber plug accommodating portions 22 in a vertical direction.

As shown in FIGS. 10 and 11, upper and lower front push-in pieces 25 project forward on an opening edge of the front rubber plug accommodating portion 22, while upper and lower rear push-in pieces 25 are provided on an opening edge of the rear rubber plug accommodating portion 22. The rear push-in pieces 25 are wider than the front push-in pieces 25.

Figure 12:
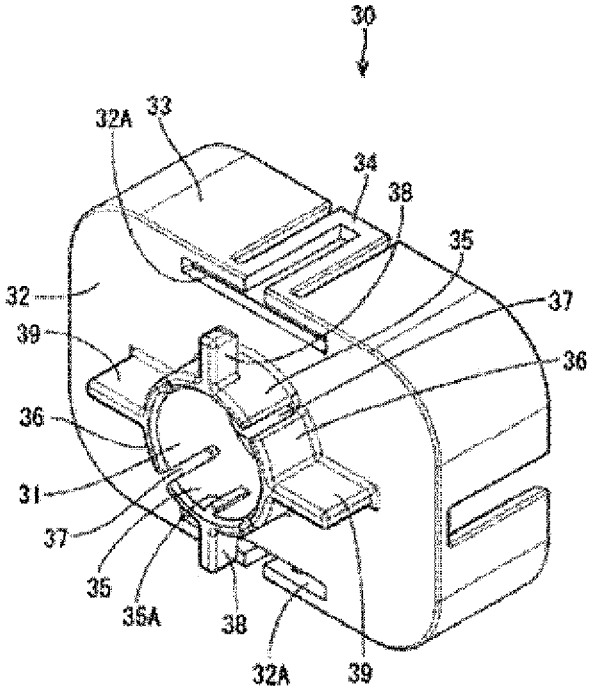
FIG. 12 is a perspective view of the retainer viewed obliquely from front.
Figure 13:
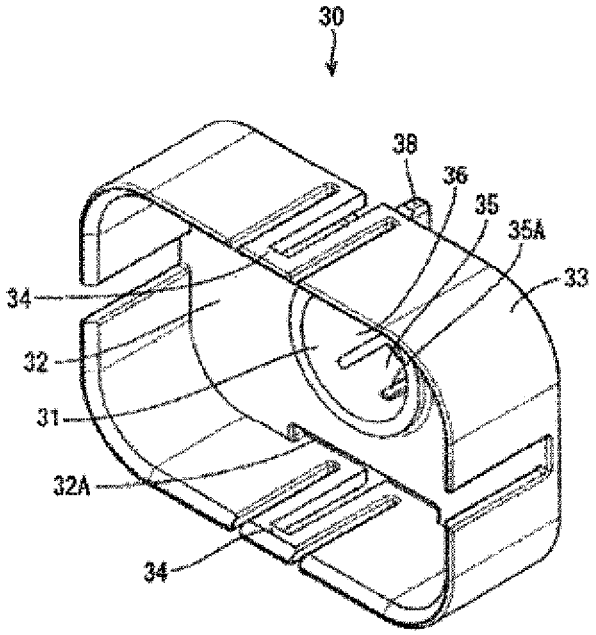
FIG. 13 is a perspective view of the retainer viewed obliquely from behind.
Figure 14:
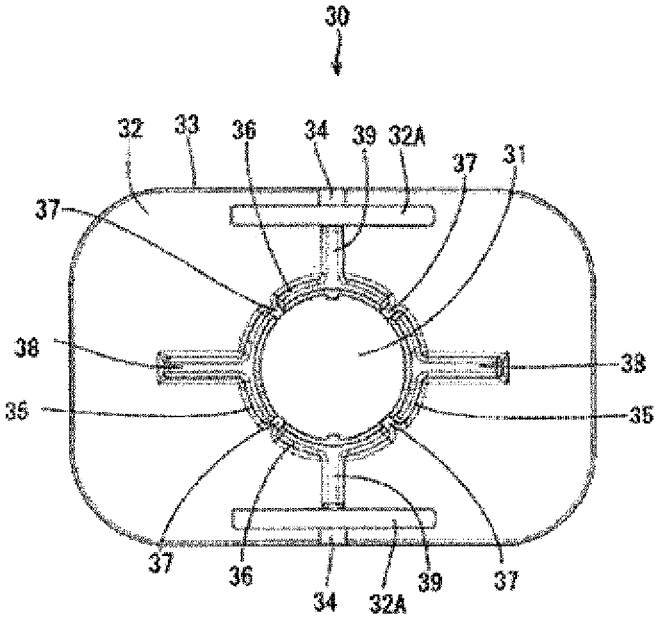
FIG. 14 is a front view of the retainer.

As shown in FIGS. 12 and 13, the first retainer 30 includes a front wall 32 with a holding hole 31 through which the first wire W1 is inserted to be held, and a peripheral wall 33 extends rearward from a peripheral edge of the front wall 32. The peripheral wall 33 is provided with upper and lower lock pieces 34. Each lock piece 34 is in the form of a cantilever substantially U shaped and projecting rearward from the front edge of the peripheral wall 33. A rear part of the lock piece 34 is locked to the lock protrusion 24 of the housing 20, as shown in FIG. 1, so that the first retainer 30 is held in a state externally fit on the rubber plug accommodating portion 22 of the housing 20. Note that since the second retainer 40 has substantially the same configuration as the first retainer 30, the second retainer 40 is not described and components corresponding to those of the first retainer 30 are denoted by reference signs obtained by adding 10 to numeric parts of reference signs of the components of the first retainer 30.

As shown in FIG. 12, the front wall 32 of the front retainer 30 is provided with two deflecting pieces 35 and two fixing pieces 36. The deflecting pieces 35 are displaceable with respect to the outer peripheral surface of the first wire W1, and the fixing pieces 36 are relatively undisplaceable with respect to the outer peripheral surface of the first wire W1. With the front retainer 30 mounted on the front rubber plug accommodating portion 22 of the housing 20, the deflecting pieces 35 and the fixing pieces 36 are arranged alternately in a circumferential direction along the outer peripheral surface of the first wire W1 and constitute a circular ring shape as a whole in a front view. Slits 37 are formed between the deflecting pieces 35 and the fixing pieces 36. A total of four slits 37 are provided and are arranged at intervals of 90°. The two deflecting pieces 35 are arranged to vertically face each other, and the two fixing pieces 36 are arranged to laterally face each other. As shown in FIG. 12, a pressing rib 35A projects radially inward on the inner peripheral surface of the deflecting piece 35 and extends in the front-rear direction.

Figure 16:
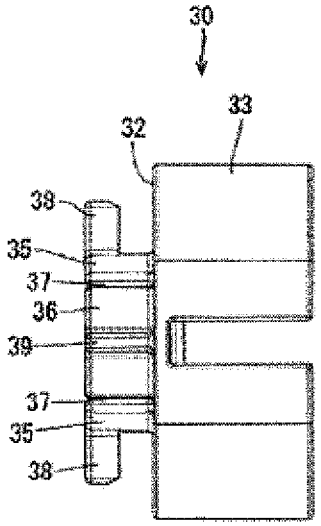
FIG. 16 is a side view of the retainer.

Upper and lower lances 38 project radially outward on the front ends of the outer peripheries of the upper and lower deflecting pieces 35. The upper lance 38 projects up from the upper deflecting piece 35, and the lower lance 38 projects down from the lower deflecting piece 35. The upper and lower lances 38 are arranged in a straight line to be aligned in the vertical direction. As shown in FIG. 16, a dimension of each lance 38 in the front-rear direction is about half of the dimension of the deflecting pieces 35 in the front rear direction.

Figure 15:
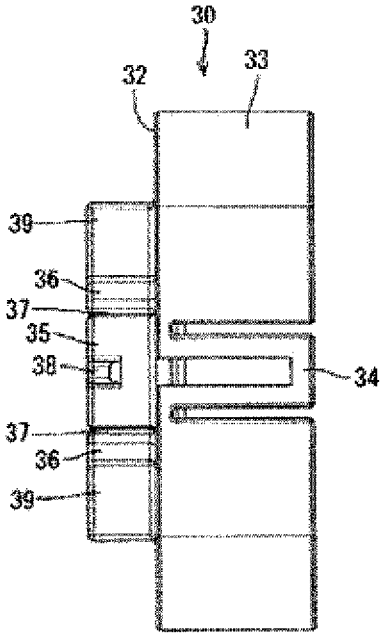
FIG. 15 is a plan view of the retainer.

As shown in FIG. 12, left and right deflection preventing ribs 39 project radially out on the outer peripheries of the left and right fixing pieces 36. The left deflection preventing rib 39 projects leftward from the left fixing piece 36, and the right deflection preventing rib 39 projects rightward from the right fixing piece 36. The left and right deflection preventing ribs 39 are arranged in a straight line to be aligned in a lateral direction. As shown in FIG. 15, a dimension of each deflection preventing rib 39 in the front-rear direction is set equal to that of the fixing pieces 36. The deflection preventing ribs 39 are coupled to both the fixing pieces 36 and the front wall 32.

As shown in FIG. 12, upper and lower push-in piece insertion holes 32A are provided in the front wall 32 of the front retainer 30 and extend in the lateral direction at positions spaced inward from base end parts of the lock pieces 34. Upper and lower push-in piece insertion holes 32A are provided to correspond to the upper and lower lock pieces 34. The push-in piece insertion holes 32A are adjacent the lock pieces 34 in the vertical direction, and each push-in piece insertion hole 32A communicates with an internal space of the adjacent U-shaped lock piece 34.

Figure 6:
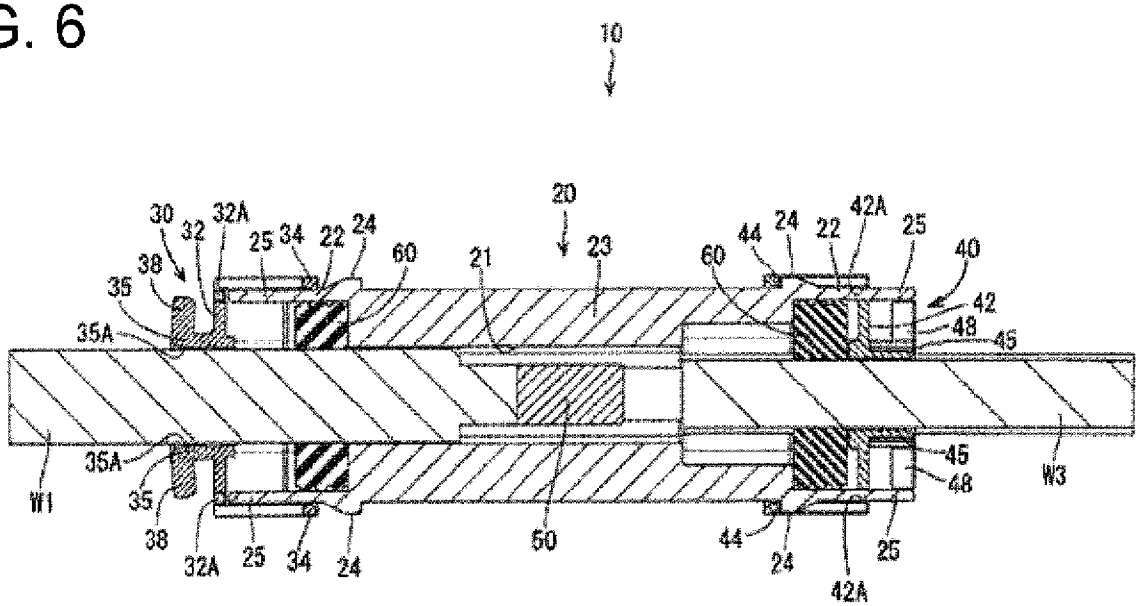
FIG. 6 is a section of the connector along B-B in FIG. 5 showing a state where the mounting of a retainer into a housing is started.
Figure 7:
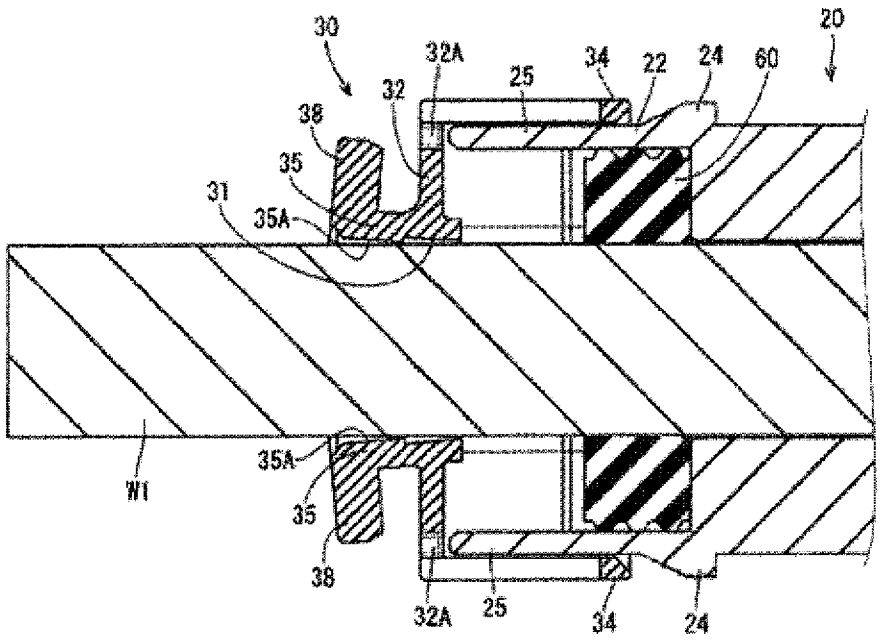
FIG. 7 is a section enlargedly showing a part of FIG. 6.

Next, the procedure of holding the first wire W1 in the housing 20 by the retainer 30 is described. As shown in FIG. 6, the rubber plug 60 mounted on the first wire W1 in advance is mounted into the rubber plug accommodating portion 22 with the first wire W1 pulled out forwardly from the front rubber plug accommodating portion 22. In this way, the rubber plug 60 is sandwiched between the outer peripheral surface of the first wire W1 and the inner peripheral surface of the rubber plug accommodating portion 22. If the front retainer 30 is mounted on the front rubber plug accommodating portion 22 from the front from this state, the pressing ribs 35A of the deflecting pieces 35 ride on the first wire W1 and the deflecting pieces 35 are inclined, as shown in FIG. 7. The pressing ribs 35A do not bite into the outer peripheral surface of the first wire W1 in this way. Thus, the outer peripheral surface of the first wire W1 is not possibly damaged by the mounting of the front retainer 30.

Figure 8:
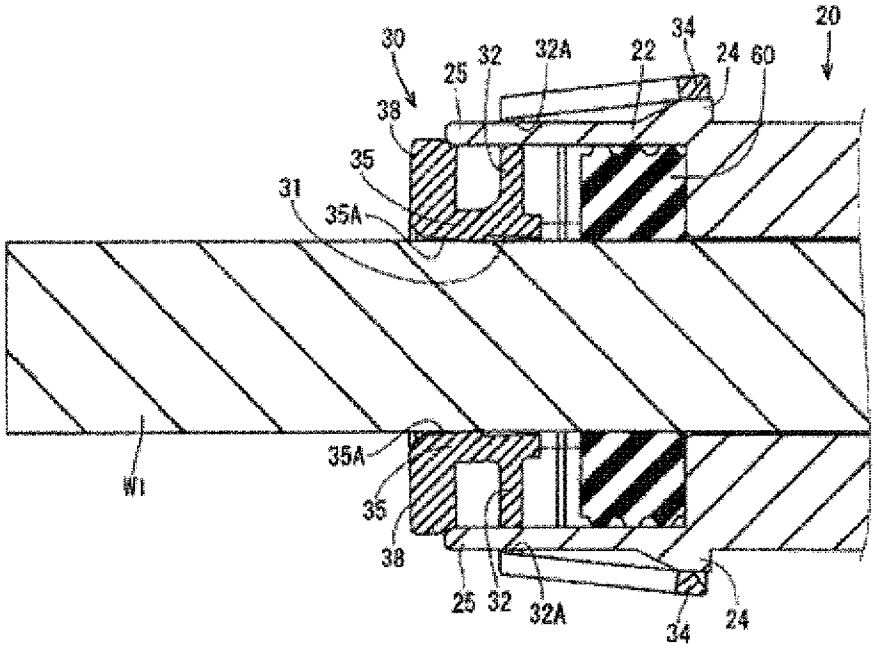
FIG. 8 is a section showing a state where the retainer is mounted to a greater extent than in a state of FIG. 7.

If the front retainer 30 is mounted farther on the front rubber plug accommodating portion 22, the lances 38 of the deflecting pieces 35 contact the front ends of the push-in pieces 25, as shown in FIG. 8. Contact parts of the lances 38 and the push-in pieces 25 are formed with tapered surfaces capable of guiding each other. Thus, the lances 38 smoothly enter the insides of the push-in pieces 25. Associated with this, the pressing ribs 35A of the deflecting pieces 35 start to bite into the outer peripheral surface of the first wire W1 via the lances 38. The vertically sandwiching of the first wire W1 by the upper and lower deflecting pieces 35 causes the first wire W1 to expand in the lateral direction. However, expansion in the lateral direction is suppressed since the left and right fixing pieces 36 are disposed on both left and right sides of the first wire W1. In addition, the deflection preventing ribs 39 prevent deflection of the fixing pieces 36 so that the fixing pieces 36 are not deflected by the first wire W1.

In this way, as shown in FIG. 9, the pressing ribs 35A of the deflecting pieces 35 bite into the outer peripheral surface of the first wire W1 and the first wire W1 is held by the front retainer 30 at the same time as the mounting of the front retainer 30 is completed. At this time, the first wire W1 is pressed and held over the entire circumference by the upper and lower deflecting pieces 35 and the left and right fixing pieces 36 with the front retainer 30 held on the housing 20. Thus, the first wire W1 is held firmly in the housing 20 via the front retainer 30. Further, since the pressing ribs 35A of the deflecting pieces 35 bite into the outer peripheral surface of the first wire W1 simultaneously with the completion of the mounting of the front retainer 30, the outer peripheral surface of the first wire W1 is not damaged by the mounting of the front retainer 30.

As described above, in this embodiment, the push-in pieces 25 of the housing 20 press the deflecting pieces 35 of the retainer (first retainer 30) into the outer peripheral surface of the wire (first wire W1) when mounting the retainer on the rubber plug accommodating portion 22 of the housing 20. The deflecting pieces 35 cause the wire to expand in a direction different from a push-in direction. However, the fixing pieces 36 suppress the expansion of the wire. Thus, the wire is pressed from both the deflecting pieces 35 and the fixing pieces 36, and the wire is held by the retainer. Therefore, the wire can be held by two components, i.e. the housing 20 and the retainer, and the number of components can be reduced as compared to the case where the wire is held by three components as before.

Further, if an attempt is made to assemble the retainer to the housing 20 with the deflecting pieces 35 pushed into the outer peripheral surface of the wire, the wire may be damaged such as by the biting of the deflecting pieces 35 and the fixing pieces 36 into a coating of the wire. However, according to the above configuration, the deflecting pieces 35 gradually push the outer peripheral surface of the wire as the retainer is assembled with the housing 20. Therefore, a force for pushing the outer peripheral surface of the wire gradually increases and the wire is less likely to be damaged.

Plural deflecting pieces 35 and plural fixing pieces 36 may be arranged alternately in the circumferential direction along the outer peripheral surface of the wire, and the slits 37 may be formed between the deflecting pieces 35 and the fixing pieces 36. According to this configuration, the deflecting pieces 35 and the fixing pieces 36 are adjacent via the slits 37. Thus, even if parts of the outer peripheral surface of the wire on both sides of the deflecting pieces 35 are going to be expanded in diameter when the outer peripheral surface of the wire is pushed by the deflecting pieces 35, the fixing pieces 36 suppress such an expansion in diameter.

The push-in pieces 25 may project forward from the opening edge of the rubber plug accommodating portion 22, and the retainer may include the front wall 32 formed with the push-in piece insertion holes 32A through which the push-in pieces 25 are inserted. According to this configuration, the front wall 32 of the retainer can be brought closer to the rubber plug accommodating portion 22 and the entire connector 10 can be reduced in size.

The fixing pieces 36 may project forward from the front wall 32, and the fixing pieces 36 and the front wall 32 may be coupled by the deflection preventing ribs 39. According to this configuration, since the fixing piece 36 is coupled to the front wall 32 and the deflection preventing rib 39 at two positions. Thus, the fixing piece 36 cannot deflect.

The deflecting piece 35 may project forward from the front wall 32, and the lance 38 may project in a displacing direction of the deflecting piece 35 on the front end of the deflecting piece 35. Furthermore, the push-in piece 25 may push the lance 38 toward the outer peripheral surface of the wire. According to this configuration, the lance 38 is located on the front end of the deflecting piece 35. Thus, the pushing of the outer peripheral surface of the wire is started at a later timing and the wire is even less likely to be damaged.

The invention disclosed by this specification is not limited to the above described and illustrated embodiment. For example, the following various modes are also included.

Although two deflecting pieces 35 are provided in the above embodiment, only one deflecting piece 35 may be provided or three or more deflecting pieces 35 may be provided. Similarly, although two fixing pieces 36 are provided in the above embodiment, only one fixing piece 36 may be provided or three or more fixing pieces 36 may be provided.

Although the slits 37 are formed between the deflecting pieces 35 and the fixing pieces 36 in the above embodiment, deflecting pieces and fixing pieces may be connected.

Although the push-in piece 25 projects forward from the opening edge of the rubber plug accommodating portion 22 in the above embodiment, a receptacle tubular over the entire periphery and projecting forward from the opening edge of the rubber plug accommodating portion 22 may serve as a push-in piece. In that case, the front retainer may be fit and mounted into the receptacle.

Although the deflection preventing rib 39 is coupled to both the fixing piece 36 and the front wall 32 in the above embodiment, a deflection preventing rib may be coupled to only one of the fixing piece 36 and the front wall 32 and may be separated from the other with a tiny clearance formed therebetween.

Although the lance 38 is provided on the front end part of the deflecting piece 35 in the above embodiment, a lance may be provided over the entire length of the deflecting piece 35.

LIST OF REFERENCE SIGNS

10 . . . connector
20 . . . housing
22 . . . rubber plug accommodating portion
25 . . . push-in piece
30 . . . front retainer

32, 42 . . . front wall
32A, 42A . . . push-in piece insertion hole
35, 45 . . . deflecting piece
36, 46 . . . fixing piece
37, 47 . . . slit
38, 48: lance
39, 49 . . . deflection preventing rib
40 . . . second retainer
60 . . . rubber plug
W1 . . . first wire
W2 . . . second wire
W3 . . . third wire

The invention claimed is:

1. A connector, comprising:

a wire;

a rubber plug fit on an outer peripheral surface of the wire;

a housing including a rubber plug accommodating portion provided to be open forward, the rubber plug being sandwiched between an inner peripheral surface of the rubber plug accommodating portion and the outer peripheral surface of the wire, and a retainer for holding the rubber plug in the rubber plug accommodating portion by being mounted on the rubber plug accommodating portion from front, wherein:

the retainer includes a deflecting piece relatively displaceable with respect to the outer peripheral surface of the wire and a fixing piece relatively undisplaceable with respect to the outer peripheral surface of the wire, the housing includes a push-in piece for pushing the deflecting piece into the outer peripheral surface of the wire, and the wire is held in the retainer by the deflecting piece pushed into the outer peripheral surface of the wire by the push-in piece and the fixing piece.

2. The connector of claim 1, wherein a plurality of the deflecting pieces and a plurality of the fixing pieces are alternately arranged in a circumferential direction along the outer peripheral surface of the wire, and slits are formed between the deflecting pieces and the fixing pieces.

3. The connector of claim 2, wherein the push-in piece is provided to project forward from an opening edge of the rubber plug accommodating portion, and the retainer includes a front wall formed with a push-in piece insertion hole through which the push-in piece is inserted.

4. The connector of claim 3, wherein the fixing piece is provided to project forward from the front wall, and the fixing piece and the front wall are coupled by a deflection preventing rib.

5. The connector of claim 3 or 4, wherein the deflecting piece is provided to project forward from the front wall, a lance portion is provided to project on a front end of the deflecting piece, and the deflecting piece is pushed into the outer peripheral surface of the wire via the lance portion by the push-in piece.

6. The connector of claim 1, wherein the push-in piece is provided to project forward from an opening edge of the rubber plug accommodating portion, and the retainer includes a front wall formed with a push-in piece insertion hole through which the push-in piece is inserted.

7. The connector of claim 6, wherein the fixing piece is provided to project forward from the front wall, and the fixing piece and the front wall are coupled by a deflection preventing rib.

8. The connector of claim 1, wherein the deflecting piece is provided to project forward from the front wall, a lance portion is provided to project on a front end of the deflecting piece, and the deflecting piece is pushed into the outer peripheral surface of the wire via the lance portion by the push-in piece.

* * * * *